US006441080B1

(12) United States Patent
Berube

(10) Patent No.: US 6,441,080 B1
(45) Date of Patent: Aug. 27, 2002

(54) REPULPABLE CHLORINE FREE BARRIER COATING FOR PACKAGING MATERIAL

(75) Inventor: Serge Berube, L'Assomption (CA)

(73) Assignee: Le Groupe Recherche I.D. Inc., Chambly (CA)

( * ) Notice: Subject to any disclaimer, the term of this patent is extended or adjusted under 35 U.S.C. 154(b) by 0 days.

(21) Appl. No.: 09/790,907

(22) Filed: Feb. 23, 2001

(51) Int. Cl.[7] ..... C08K 3/34; C08K 3/28
(52) U.S. Cl. ..... 524/449; 524/428; 524/451
(58) Field of Search ..... 524/428, 449, 524/451

(56) References Cited

U.S. PATENT DOCUMENTS 5,492,741 A * 2/1996 Akao et al. ..... 428/35.2
5,562,980 A * 10/1996 Koutitonsky ..... 428/324
5,929,155 A * 7/1999 Berube ..... 524/425
6,312,828 B1 * 11/2001 Akao ..... 428/516

* cited by examiner

*Primary Examiner*—Kriellion A. Sanders
(74) *Attorney, Agent, or Firm*—Crowell & Moring LLP

(57) ABSTRACT

This invention relates to a chlorine free, wax free aqueous composition for providing a repulpable water vapor barrier coating for flexible packaging applications. The composition includes a tackifier resin, a polymer and enough water to provide dispersions of the tackifier resin and the polymer. It may also include a filler with a plate like structure.

16 Claims, No Drawings

REPULPABLE CHLORINE FREE BARRIER COATING FOR PACKAGING MATERIAL

BACKGROUND OF INVENTION (a) Field of the Invention

This invention relates to a composition for providing a repulpable chlorine free moisture vapor barrier coating for packaging material, especially flexible packaging material. This invention also relates to a method of coating a flexible packaging material with such composition and to repulpable packaging materials provided with such coating.

(b) Description of Prior Art

Polyethylene films and wax coatings, which are generally laminated or coated on paper and paperboard are widely used in packaging applications to protect products from moisture. However, it is well known that packaging containing polyethylene films and wax coatings are considered to be non repulpable mainly because they introduce quality problems in the fiber recovery process.

Polyethylene films and wax coatings are considered by waste dealers to be contaminant and if inadvertently used by a recovery mill, they will introduce quality problems into the fiber recovery process either by upsetting the process (plugging the screens) or contaminating the finished product.

Polyvinylidene chloride copolymer (PVdC) is another type of moisture barrier coating which provides outstanding moisture barrier and which is widely used in packaging applications. However, because of its Theological properties, PVdC does not easily form a continuous film onto the cellulose-based substrates used for packaging. Thus, to achieve the required water vapor barrier performances, the application of a heavy weight coat is necessary. However, heavy weight coat PVdC that contains chlorinated hydrocarbons has a negative impact on the environment.

There has been considerable concern about the environmental impact of chlorinated hydrocarbons. Market forces have been pressing for decreased use of chlorine and chlorine containing compound packaging. This has required a search for, alternate water vapor barrier coatings, or to decrease the amount of PVdC used in packaging.

U.S. Pat. No. 5,929,155 to Bérubé disclosed a modified PVdC composition, which permits a lighter coat weight than a regular PVdC with excellent water vapor barrier properties. In addition, packaging materials provided with such coatings are repulpable.

U.S. Pat. No. 5,562,980 to Koutitonsky discloses a multilayer paper composition which is easily repulpable and which contains a layer of PVdC.

EP 0 718 437 A1 to Wittosh et al. discloses a repulpable paper stock provided with a base coat which contains PVdC as the main water vapor barrier ingredient.

From the prior art mentioned above, it seems that these coatings, even though they require lesser amounts of PVdC, still needs PVdC to give the necessary water vapor barrier requirement for packaging applications.

Some acrylic copolymers are also suggested in the prior art, however they have limited water vapor barrier and do not meet the necessary requirement for packaging applications. There has been a call for chlorine free paper products by environmental groups, by consumer groups, producers, retailers and government agencies. Thus, it would be desirable to have an alternative for conventional polyethylene films, wax coatings, PVdC and coatings containing PVdC that has comparable water vapor barrier properties but also has the added benefit or repulpability, A chlorine free, wax free repulpable water vapor barrier coating should have the following essential properties:

- excellent water vapor barrier property at 100% RH and 37.8° C. (tropical conditions);
- good rheological properties to achieve a continuous film on paper and paperboard to provide the necessary water vapor barrier when applied at low weight;
- good water resistance;
- good flexibility at room temperature;
- no blocking;
- be repulpable as defined in U.S. Pat. No. 5,929,155;
- be based on non polluting technology which is essentially a chlorine free, wax free, formaldehyde free water based dispersion mixture On the other hand, it is known that water vapor transmission rate takes place through a mechanism that is different than for liquid water, a water vapor barrier coating depends on a continuous film and its degree of crystallization that restricts the passage of water vapor.

The use of free chlorine compositions in providing a repulpable moisture vapor barrier is described in U.S. Pat. No. 5,897,411 which discloses a resin latex which may be carboxylated styrene butadiene and a hydrophobic component which may be mica, talc, silica, clay or kaolin. This composition does not provide a satisfactory coating on packaging material.

On the other hand, U.S. Pat. No. 6,103,809 discloses a thermoplastic composition which may be used as repulpable/recyclable adhesives and which comprises a crystalline water sensitive thermoplastic polymer blended with an amorphous water sensitive thermoplastic polymer. Tackifyier resins such as glycerol ester of hydrogenated rosin may also be included in the composition. This composition cannot be used to provide a moisture vapor barrier coating for paperboard or the like.

U.S. Pat. No. 4,284,542 discloses a hot melt adhesive composition, which includes an alkali metal ionomer of a random copolymer of ethylene methyl acrylate, a carboxylated termonomer, as well as a tackifier and a plasticizer.

U.S. Pat. No. 4,650,822 discloses an adhesive composition, which includes an elastomeric, polymeric resin, a tackifier and a terpene ether.

SUMMARY OF INVENTION

It is an object of the present invention to provide a repulpable, chlorine free, wax free, water vapor barrier coating for flexible packaging that is capable of commercial applications.

It is another object of the present invention to provide a repulpable coating for flexible packaging material, which is based on the combination of a tackifier and a polymer.

These and other objects of the invention may be achieved by providing a composition for providing a chlorine free vapor barrier coating for flexible packaging material, which comprises a tackifier resin, a hydrophobic chlorine free polymer having a Tg between about −40° C. and 45° C. and a minimum film forming temperature (MFFT) which is substantially the same or above the Tg of the polymer and which is capable of bonding crystallized tackifier resin to a substrate, and water in an amount sufficient to provide aqueous dispersions of the tackifier resin and the chlorine free polymer.

According to a preferred embodiment, the coating composition according to the invention may comprise a filler, which has a plate like structure, such as mica or talc, and enough water to disperse the filler in the aqueous phase. In this case, the hydrophobic chlorine free polymer must also be capable of bonding the filler.

The invention also relates to a method, which comprises coating the composition according to the invention on a flexible packaging material, and to a flexible packaging material as obtained by the method according to the invention.

DESCRIPTION OF PREFERRED EMBODIMENTS

Tackifier, which are either natural or synthetic resinous materials, are mainly used in the formulation of pressure sensitive adhesives to impart tack. In a lesser degree, they are also used in the formulation of other types of adhesives to impart tack as well.

According to the present invention, tackifiers are used for their tendency to crystallize. Tackifiers by themselves are unsuitable for use in water vapor barrier packaging coatings because the resulting film is either hard or brittle or soft and tacky and does not provide the necessary water vapor barrier requirement for packaging applications.

One important polymer property, which has a significant impact on the barrier performance of the coating, is the glass transition temperature (Tg) or the softness of the polymer, The Tg of the polymer defies the extent of compaction of the coating during drying. The lower the Tg of the polymer (or the softness of the polymer), the better the degree of compaction of the coating. As a result, the final coating structure will be more "close". This has a significant impact on the moisture barrier performance as will be observed hereinbelow.

According to the present invention, the preferred composition for use in providing a repulpable, chlorine free, wax free water vapor barrier coating comprises a tackifier resin, the above-defined polymer and filler The tackifier is preferably an aqueous dispersion of glycerol ester of hydrogenated rosin. One particular commercially available source is an aqueous dispersion of glycerol ester of hydrogenated rosin, which is sold under the trademark Staybelite ester 10.55WK by Hercules Inc. It is described as a dispersion in water having a content of rosin of about 55% (55%±1%), a pH of 9.00 to 10.0, a viscosity at 25° C. of 1450 cps to 3050 cps and a softening point of 73° C. Rosin esters, rosin acids and mixtures of rosins and rosin derivatives may also be used within the scope of the present invention.

The polymer is preferably a carboxylated styrene butadiene copolymer dispersion. One commercially available source of carboxylated styrene butadiene copolymer dispersion is sold under the trademark Styronal BN 4606X by BASF and is described as a dispersion in water having a polymer content of about 50% (50%±1%), a pH of 6.5 to 7,5, a Brookfield viscosity at 23° C. of 350 cps and a glass transition temperature Tg of 6° C. The dispersion is further described as being anionic and having a density of 1.01 g/cm$^3$. Polyvinyl acetate, polyvinyl alcohol polyvinyl acetate-ethylene, polyvinyl acrylic and polyacrylic dispersions may also be used within the scope of this invention, under conditions that they are not to be softened by water. Styrene acrylic copolymer dispersions and acrylic polymer dispersions, which are water-resistant, may also be used according to this invention. The above mentioned acrylic copolymers are preferably derived from butyl acrylate, 2-ethyl hexyl acrylate and generally higher alkyl acrylates.

The above polymers may also contain functional groups such as COOH, $CONH_2$, OH and the like, to enhance mechanical stability, wettability, runnability and adhesion on cellulose substrate. Runnability is defined as the ability to apply a coating formulation which maintain coat weight control without encountering significant coating defect.

The preferred filler is mica. One particular commercially available source of mica is sold under the trademark Alsibronz 32 by Engelhard Corporation, and is described as having an average particle size of 32$\mu$, and a specific gravity of 2.8–3.0. While mica provides excellent results, other filler such as talc or any filler having a plate like structure can also be used according to the present invention.

The aqueous moisture barrier coating according to the invention comprises water in an amount sufficient to provide an aqueous dispersion of the tackifier resin and an aqueous dispersion of the polymer, and also to disperse the filler, when the latter is present in the composition. The repulpable chlorine free, wax free, water vapor barrier coating may additionally contain a dispersing agent which is used to disperse the filler into the aqueous phase. Dispersing agents are well known to those skilled in the art and their choice is left entirely to the expert in the field.

The repulpable water vapor barrier coating may also contain a thickening agent to aid in dispersing the filler into the aqueous phase. Again, the choice is entirely left to one skilled in the art. A buffer, such as ammonia, may also be added to the composition to adjust the pH to a value between about 7.0 and 10.0 and to more easily disperse the filler. Finally, a defoaming agent may be necessary to prevent any foaming during dispersion of the filler. The choice of defoaming agents is left entirely to one skilled in the art.

In general, the repulpable, chlorine free, wax free, water vapor barrier coating composition according to the invention, may comprise:

| | | |
|---|---|---|
| tackifier resin: | 5 to 90 | weight percent (based on 55% solids) |
| polymer dispersion: | 49 to 10 | weight percent (based on 50% solids) |
| filler: | 0 to 35 | weight percent |
| dispersing agent: | 0 to 1.0 | weight percent (based on 30% solids) |
| thickener: | 0 to 0.5 | weight percent (based on 25% solids) |
| defoamer: | 0 to 0.06 | weight percent |
| buffer: | 0 to 1.0 | weight percent |
| water: | 0 to 30 | weight percent. |

The foregoing invention having been described, the following examples are provided to further teach preferred embodiments and to aid those skilled in tile art in the practice of the invention.

In the following examples, the coating weights referred to are dry coating weight. The water transmission rate was determined using an instrument sold under the trademark Mocon.

EXAMPLE 1

The substrate is a 127 g/m$^2$ linerboard. The coating has the following composition:

| Ingredient | Weight percent |
|---|---|
| Staybelite ® 10.55 WK | 60.60 |
| Styronal ® BN 4606X | 15.20 |

-continued

| Ingredient | Weight percent |
|---|---|
| Dispersant | 0.42 |
| Colloids 60 (defoamer) | 0.04 |
| Sterocoll ® FD (thickener) | 0.25 |
| Mica Alsibronz ® 32 | 11.02 |
| Water | 12.47 |

The coating composition has a Brookfield viscosity of 1200 cps and a solid content of 52%.

The coating was applied in known manner to the substrate and results in dry add-on level in the range of 25 g/m$^2$. The aqueous coating composition was applied with a rod coater double bump and air-dried at 110° C.

The results are as follows:

| Coating weight | WVTR* 100% RH, 37.8° C. | Repulpability |
|---|---|---|
| 25 g/m$^2$ | 31 g/m$^2$/day | <<1/16" |
| 30 g/m$^2$ | 18 g/m$^2$/day | <<1/16" |

*Water vapor transmission rate 100% RH, 37.8° C.

EXAMPLE 2

The same materials and procedure as in example 1 were used except that the mica used bad an average particle size of 39 microns.

| Coating weight | WVTR 100% RH, 37.8° C. | Repulpability |
|---|---|---|
| 25 g/m$^2$ | 41 g/m$^2$/ day | <<1/16" |
| 30 g/m$^2$ | 20 g/m$^2$/day | <<1/16" |
| Viscosity: 1300 cps | | |

EXAMPLE 3

The same materials and procedure as in example 1 were used except that the mica used had an average particle size of 55 microns.

| Coating weight | WVTR 100% RH, 37.8° C. | Repulpability |
|---|---|---|
| 21 g/m$^2$ | 28 g/m$^2$/day | <<1/16" |
| 34 g/m$^2$ | 28 g/m$^2$/day | <<1/16" |
| Viscosity: 100 cps | | |

EXAMPLE 4

The same materials and procedure as in example 1 were used except that in the case of mica the source was from Zemex Industrial Mineral and is sold under the trademark Suzerite 325 HK. It has an average particle size of 21 microns.

| Coating weight | WVTR 100% RH, 37.8° C. | Repulpability |
|---|---|---|
| 25 g/m$^2$ | 36 g/m$^2$/day | <<1/16" |
| 30 g/m$^2$ | 32 g/m$^2$/day | <<1/16" |

EXAMPLE 5

The substrate is still a 127-g/m$^2$ linerboard. The coating composition is as follows:

| Ingredient | Weight percent |
|---|---|
| Staybelite 10.55 WK | 51.94 |
| Styronal ® BN 4606X | 13.00 |
| Dispersant | 0.60 |
| Colloid 60 | 0.06 |
| Sterocoll ® FD | 0.36 |
| Mica Alsibron 32 | 16.00 |
| Water | 18.04 |

The coating has a Brookfield viscosity of 1600 cps and a solid content of 51%.

| Coating weight | WVTR 100% RH, 37.8° C. | Repulpability |
|---|---|---|
| 25 g/m$^2$ | 29 g/m$^2$/day | <<1/16" |
| 30 g/m$^2$ | 19 g/m$^2$/day | <<1/16" |

EXAMPLE 6

The substrate is the same as in example 5. The coating composition is as follows:

| Ingredient | Weight percent |
|---|---|
| Staybelite 10.55 WK | 36.36 |
| Styrene acrylic | 24.02 |
| Water | 21.62 |
| Ammonia | 0.30 |
| Dispersant | 0.70 |
| Sterocol FD | 0.30 |
| Delaminated mica (Alsibronz 55) | 16.70 |

Results

When the styrene acrylic polymer is Acronal S 728® from BASF, the Tg is 22° C., MFFT is 16° C. and the WVTR is 132 g/m$^2$/day. When the styrene acrylic polymer is Acronal NX 4786® from BASF, Tg is 22° C., MFFT is 20° C. and WVTR is 104 g/m$^2$/day.

This example shows the influence of water resistance of the dried polymer (film) on the barrier performance of the coating. As mentioned above, polymers that provide better hydrophobic properties are those where the MFFT is almost the same or above the Tg of the polymer. A polymer having a MFFT≧Tg means that the polymer is not plasticized or softened by water during film formation and consequently will provide better barrier performance to the chlorine free coating formula. In the present example NX 4786 is closer (−2° C.) to Tg than Acronal S728 (−6° C.) and the barrier performance is better, 104 g/m$^2$/day as opposed to 132 g/m$^2$/day.

EXAMPLE 7

In this example, a different type of tackifier (Snowtack® 765 f from Eka Chemicals, was used.

| | |
|---|---|
| Snowtack 765 f | 47.20 |
| Styronal BN 4606 X | 12.42 |
| Water | 22.08 |
| Ammonia | 0.3 |
| Dispersant A (?) | 0.7 |
| Colloid 963 (?) | 0.04 |
| Sterocoll ® FD | 0.4 |
| Delaminated mica (Alsibronz 55) | 16.86 |

This composition was coated on a 126 g/m$^2$ linerboard with a 30 g/m$^2$ coat weight and the result is a WVTR (100% RM, 37.8° C.) of 47.8 g/m$^2$/day

EXAMPLE 8

80 weight percent of the tackifier Staybelite 1055 WK were blended with 20 weight percent of carboxylated styrene butadiene dispersions of different Tg. With Styronal® ND 834, Tg (° C.) of 46, the WVTR (g/m$^2$/day) 100% RH, 37.8° C., was 60. With Styronal® ND 656, Tg was 18, the WVTR was 51. With Styronal® ND 593, Tg of 5, the WVTR was 45, and with Styrofan® D 422, Tg of −10, the WVTR was 34. Of course, the Tg of the binder has a direct influence on the repulpability of the coating. The higher the Tg, the better is the repulpability of the coating. This example also shows the influence of Tg on barrier performance.

EXAMPLE 9

The coating composition was the following:

| | |
|---|---|
| Staybelite 10.55 | 22.51 weight percent |
| Styronal BN 4606X | 27.52 weight percent |
| Water | 27.20 weight percent |
| Ammonia | 0.18 weight percent |
| Dispersant | 0.90 weight percent |
| Defoamer | 0.05 weight percent |
| Sterocoll FD (thickener) | 0.27 weight percent |
| Alsibronz 32 | 19.85 weight percent |
| Aluminum silicate | 10.52 |

This composition was coated on a 126-g/m$^2$ linerboard with 25-g/m$^2$-coat weight and the result is a VVVTR of 48.6 g/m$^2$/day.

The aluminum silicate used had a thin platelet structure and is sold under the Trademark ASP NC by Engelhard. The ASP NC had an average particle size of 0.7 microns.

Although the invention has been described with reference to the above examples, it is understood that modifications are possible within the scope of the appended claims.

I claim:

1. A composition for providing a repulpable chlorine free vapor barrier coating for flexible packaging material, which comprises a tackifier resin, a hydrophobic chlorine free polymer having a Tg between about −40° C. and 45° C. and a minimum film forming temperature which is substantially the same or above the Tg of the polymer and which is capable of bonding crystallized tackifier resin to a substrate, and water in an amount sufficient to provide aqueous dispersions of said tackifier resin and said hydrophobic chlorine free polymer.

2. Composition according to claim 1, which additionally comprises a filler having a plate like structure, and enough water to disperse the filler in the composition, said hydrophobic chlorine free polymer also capable of bonding said filler to said substrate.

3. Composition according to claim 1, wherein said tackifier resin is selected from the group consisting of rosin esters, rosin acids and mixtures thereof.

4. Composition according to claim 3, wherein said tackifier resin comprises a glycerol ester of hydrogenated rosin.

5. Composition according to claim 1, wherein said chlorine free polymer is selected from the group consisting of polyvinyl acetate, polyvinyl alcohol polyvinyl acetate-ethylene, polyvinyl acrylic and polyacrylic, and a carboxylated styrene butadiene.

6. Composition according to claim 1, wherein said polymer is present in said composition as an anionic dispersion which has a density of about 1.01 g/cm$^3$.

7. Composition according to claim 6, wherein said composition is a carboxylated styrene butadiene copolymer dispersion.

8. Composition according to claim 2, wherein said filler is selected from the group consisting of mica and talc.

9. Composition according to claim 8, wherein said filler comprises mica.

10. Composition according to claim 1, which additionally comprises a dispersing agent capable of dispersing the filler into water.

11. Composition according to claim 10, which comprises a thickening agent capable of improving dispersion of the filler in water.

12. Composition according to claim 1, which comprises ammonia in an amount sufficient to adjust pH to between about 7.0 and 10.0 to improve dispersion of the filler in water.

13. Composition according to claim 1, which comprises a defoaming agent in an amount sufficient to prevent foaming when said filler is dispersed in water.

14. A composition for providing a repulpable chlorine free vapor barrier coating for flexible packaging material, which comprises.

| | | |
|---|---|---|
| tackifier resin: | 5 to 90 | weight percent (based on 55% solids) |
| polymer dispersion: | 49 to 10 | weight percent (based on 50% solids) |
| filler: | 0 to 35 | weight percent |
| dispersing agent: | 0 to 1.0 | weight percent (based on 30% solids) |
| thickener: | 0 to 0.5 | weight percent (based on 25% solids) |
| defoamer: | 0 to 0.06 | weight percent |
| buffer: | 0 to 1.0 | weight percent |
| water: | 0 to 30 | weight percent. |

15. A method for providing a chlorine free, wax free repulpable water vapor barrier coating on flexible packaging material, which comprises coating a composition according to claim 1 on said flexible packaging material.

16. Flexible packaging material having a coating obtained by the method of claim 15.

* * * * *